US005214230A

United States Patent [19]

Takano et al.

[11] Patent Number: 5,214,230

[45] Date of Patent: May 25, 1993

[54] MUSICAL TONE DATA COMPENSATION APPARATUS

[75] Inventors: Junichi Takano; Yasushi Sato, both of Hamamatsu, Japan

[73] Assignee: Kabushiki Kaisha Kawai Gakki Seisakusho, Shizuoka, Japan

[21] Appl. No.: 745,150

[22] Filed: Aug. 15, 1991

[30] Foreign Application Priority Data

Aug. 17, 1990 [JP] Japan ..... 2-216568

[51] Int. Cl.[5] ..... G10H 1/38; G10H 1/24

[52] U.S. Cl. ..... 84/613; 84/617; 84/626; 84/637; 84/655; 84/658; 84/669

[58] Field of Search ..... 84/613, 617, 626, 637, 84/655, 658, 669

[56] References Cited

U.S. PATENT DOCUMENTS

| | | | |
|---|---|---|---|
| 4,633,750 | 1/1987 | Sakai | 84/658 X |
| 4,674,382 | 6/1987 | Yorihisa | 84/626 |
| 4,920,849 | 5/1990 | Mizuno | 84/613 |
| 4,972,753 | 11/1990 | Adachi et al. | 84/626 |
| 5,029,508 | 7/1991 | Suzuki et al. | 84/616 |
| 5,056,401 | 10/1991 | Yamaguchi et al. | 84/635 |

*Primary Examiner*—William M. Shoop, Jr.
*Assistant Examiner*—Brian Sircus

[57] ABSTRACT

A musical tone data compensation apparatus which detects chord components in a performance data stored in accordance with operation of a keyboard and modifies touch data of each tone composing a chord. New touch data are generated by compression or expansion of each difference in touch data with referring to a representative touch data in a block of chord tones, so that emphasis or smoothness is given to a sequence of chords.

13 Claims, 10 Drawing Sheets

FIG. 11

| KEY-ON TIMING (STEP TIME) | NOTE (KEY NUM.) | ORIGINAL TOUCH DATA (VEL-ORG) | COMPENSATED TOUCH DATA (VEL-NEW) | REP. AV |
|---|---|---|---|---|
| 1-43 | E2 | 116(L) | 104 | 92 |
| 1-45 | G3 | 102(1) | 97 | |
| 1-47 | B3 | 82(2) | 87 | |
| 1-47 | F#4 | 78(5) | 85 | |
| 1-48 | D4 | 84(3) | 88 | |
| 1-91 | A2 | 115(L) | 115 | |
| 1-94 | C#4 | 107(3) | 105 | 103 |
| 1-95 | E4 | 91(5) | 97 | |
| 2-00 | B3 | 104(2) | 104 | |
| 2-00 | G3 | 110(1) | 107 | |
| 2-94 | F#3 | 96(1) | 91 | 86 |
| 2-95 | A3 | 85(2) | 86 | |
| 3-00 | C#4 | 78(3) | 82 | |
| 3-00 | E4 | 72(5) | 79 | |
| 3-01 | D2 | 98(L) | 92 | |

← NON-CHORD TONE

MUSICAL TONE DATA COMPENSATION APPARATUS

BACKGROUND OF THE INVENTION

1. Field of the Invention

The present invention relates to a musical tone data compensation apparatus for processing and modifying performance data including of a sequence of musical tone data.

2. Description of the Prior Art

Some electronic musical instrument systems can reproduce software programs of, e.g., melodies or accompaniments created in advance using convertible recording media. Such a software program includes a sequence of performance data such as note data, key-on and key-off timing data, key-on duration data, key-on strength (key-on velocity) data, and the like of a keyboard, and is also called a sequence software program. The sequence software program is edited or created using a special-purpose edit apparatus or an electronic musical instrument having a simple edit function. However, in order to attain a quality music work, a skilled data edit operation is required, and is not easy for normal users or musicians.

As described above, it is very difficult to edit performance data to obtain a desired music piece. It is particularly difficult for beginners to edit touch data of accompaniment chords (data associated with key-on operations such as key-on strengths). More specifically, when touch data of tones constituting a chord are to be edited, a chord must be detected from musical tone data constituting performance data. In general, however, since a plurality of musical tone data which are obtained at perfectly the same key-on timing are regarded as a chord, musical tone data obtained at slightly different key-on timings cannot be regarded as a chord. Therefore, even when a display unique to a chord (mark display, color display, or the like) is made on a display device so as to identify a chord, it is difficult to reliably identify a chord.

A technique for performing even compensation of key-on strength values as a kind of touch data for musical tone data in a designated range (regardless of single tones or a chord) upon editing of touch data of a chord is known. With this technique, however, compensated musical tones undesirably have flat sounds as a whole. For this reason, a demand has arisen for compensation of touch data in units of chords so as to attain a chord sequence which is not monotonous or dull in the overall flow of a music piece.

SUMMARY OF THE INVENTION

It is an object of the present invention to provide a musical tone data compensation apparatus which can reliably detect chord components from musical tone data, and can compensate for touch data in units of chords, so that even a beginner can easily and satisfactorily edit touch data of chords to obtain a desired chord sequence.

A musical tone data compensation apparatus according to the present invention comprises chord detection means for extracting, as a chord, a group of musical tone data, which have a difference in tone generation timings of individual musical tones smaller than a predetermined threshold value, from performance data consisting of a sequence of musical tone data including touch data associated with a key-on operation, representative value detection means for detecting a representative value AV of values of touch data of the detected chord, and compensation calculation means for calculating new values of individual touch data obtained by compressing or expanding differences between the values TD of the individual touch data and the representative value at a predetermined ratio, and the apparatus obtains musical tone data including the compensated new values of the touch data of the chord.

Even when key-on timings are shifted from each other, if the shift of the timings falls within a predetermined threshold value, a chord can be reliably detected, and touch data having new values obtained by compressing or expanding differences between respective touch data of chord tones and a representative value at a predetermined ratio are set. When a compression or expansion ratio (compensation coefficient) is changed, a chord having small variations in touch data values, or a chord having emphasized variations can be desirably obtained. Therefore, for example, when key-on strength value data are compensated using this apparatus, and the differences between key-on strength values of chord tones and a representative value are compressed, a chord sequence having a good sound which is not monotonous in the overall flow of a music piece can be obtained.

BRIEF DESCRIPTION OF THE DRAWINGS

FIG. 11 shows a sequence of musical tone data for exemplifying touch data compensation.

DETAILED DESCRIPTION OF THE PREFERRED EMBODIMENTS

Figure 1:
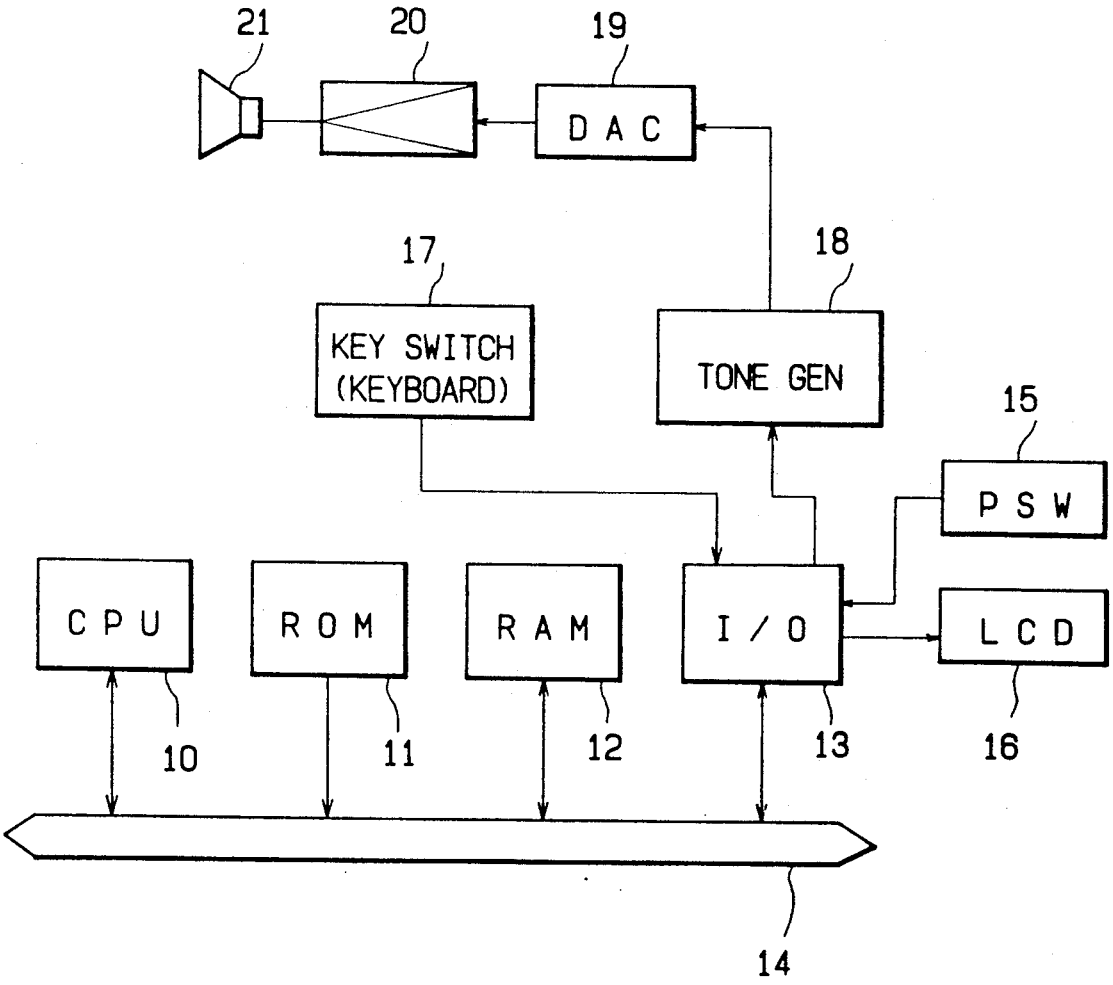
FIG. 1 is a block diagram of a sequencer as a musical tone data compensation apparatus according to an embodiment of the present invention.

FIG. 1 is a block diagram for explaining an arrangement of a data edit apparatus (to be referred to as a "sequencer" hereinafter) used when performance data is to be edited.

The sequencer is arranged integrally with or separately from an electronic musical instrument, and comprises a microcomputer system including a CPU 10, a ROM 11, a RAM 12, an input/output interface (I/O) 13, and a system bus 14. The I/O 13 is connected to a key switch 17 corresponding to a keyboard, and a panel switch (PSW) 15 for setting performance parameters such as a tone color, tempo, and the like, and parameters for processing (modifying) data. The I/O 13 is also connected to an LCD (liquid crystal display) 16 for displaying a message for a performer or an editor, and a tone generator 18 for receiving a musical tone control signal corresponding to performance data from the CPU 10. The tone generator 18 comprises a plurality of tone generation channels having PCM sound sources corresponding to a piano, violin, and the like, and forms a musical tone signal having a predetermined frequency, waveform, amplitude, sustain time, and the like on the basis of the musical tone control signal from the CPU 10. The musical tone signal is converted into an analog audio signal by a D-A converter (DAC) 19, and the analog signal is reproduced via an amplifier 20 and a loudspeaker 21.

A fetching operation of operation data from the key switch 17 and the PSW 15, and an output operation of the musical tone control signal via the I/O 13 are performed upon execution of an I/O routine program written in the ROM 11 by the CPU 10. The ROM 11 also stores a program for performing compensation (modification) processing of sequence data (to be described later). The RAM 12 includes a working area for the CPU 10, an arithmetic buffer, and an area for temporarily storing a musical tone data group to be processed.

Figure 2:
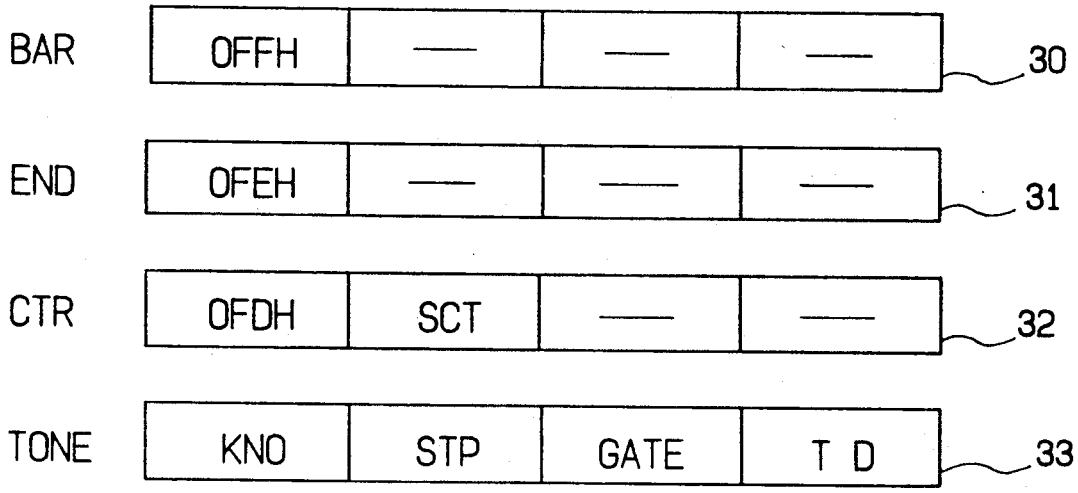
FIG. 2 shows a format of performance data processed in a system shown in FIG. 1.

FIG. 2 shows a format of musical tone data processed in the system shown in FIG. 1. BAR 30 is a data format indicating a division of bars, and consists of one byte having a content "0FFH" (H: hexadecimal notation), and three bytes whose contents are indefinite (data to be incremented stepwise). END 31 is a data format indicating the end of a music piece, and consists of one byte having a content "0FEH", and three bytes whose contents are indefinite. CTR 32 is a format of control data indicating switching of tone colors, control of a tone volume, a change of a performance tempo, and the like, and consists of one byte having a content "0FDH", one-byte data SCT1 indicating a control content (object), and two-byte control numeric value data.

TONE 33 is a format indicating each musical tone data to be generated, and consists of one byte indicating a key number KNO (1th to 127th keys) to be subjected to tone generation, one-byte step time data STP (0 to 191) indicating a tone generation timing from a bar by the number of clocks, 1-byte gate time data GATE (0 to 255) indicating a tone generation sustain time, and 1-byte touch data TD (0 to 127) indicating a key-on strength. Note that the key-on strength is detected by a key-on velocity sensor arranged in each key, and is also called velocity data.

Figure 3:
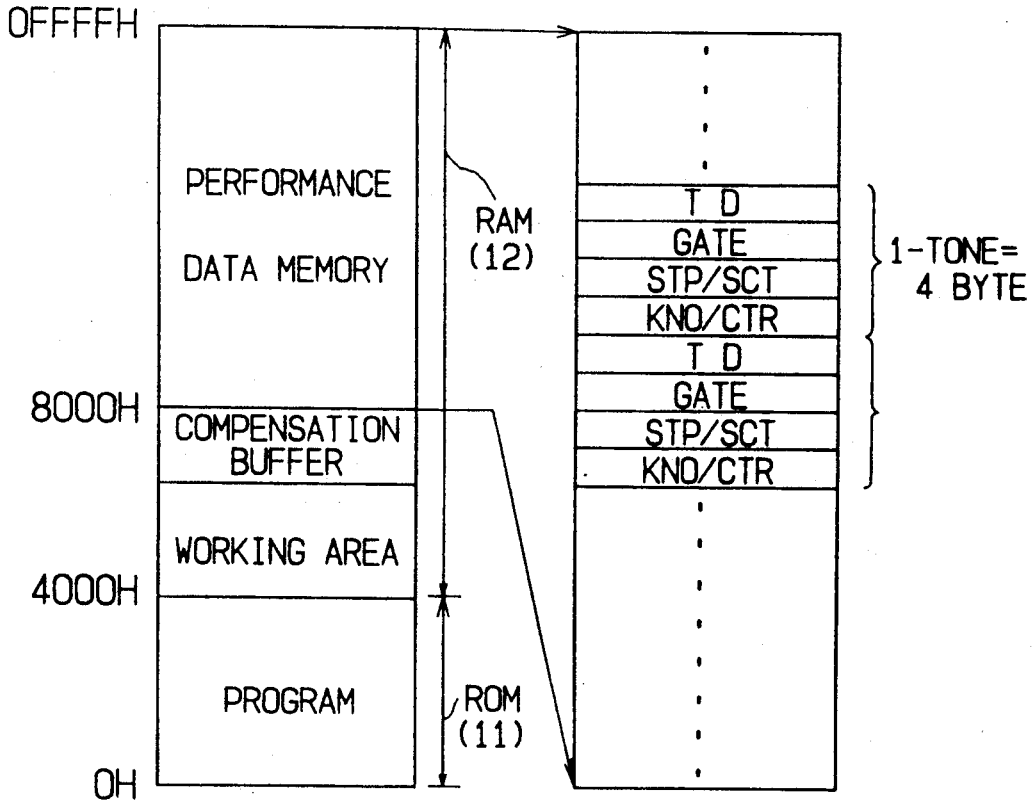
FIG. 3 shows a map of a memory to be accessed by a CPU shown in FIG. 1.

FIG. 3 shows a memory map to be accessed by the CPU 10 in this embodiment. The CPU 10 accesses the program ROM 11 from address 0H to address 3FFFH, and accesses the data RAM 12 after address 3FFFH. The area (4000H to 0FFFFH) of the RAM 12 is roughly divided into two areas. Addresses 4000H to 7FFFH are used by the CPU 10 as a working area and a buffer area for data modification processing (to be described later). Addresses 8000H to 0FFFFH are used as an area for temporarily storing performance data.

Performance data are sequentially stored from a lower address toward a higher address according to progress of a music piece in accordance with the formats shown in FIG. 2. FIG. 3 exemplifies musical tone data each of which is expressed by four bytes per tone, and consists of key number data KNO, step time data STP, gate time data GATE, and touch data TD. 4-byte bar data BAR are inserted between these musical tone data at a given time interval, and when a tone color or a performance tempo is changed during the progress of a music piece, 4-byte control data (CTR, SCT, 2-byte numeric value data) is inserted in accordance with a change content.

Figure 4:
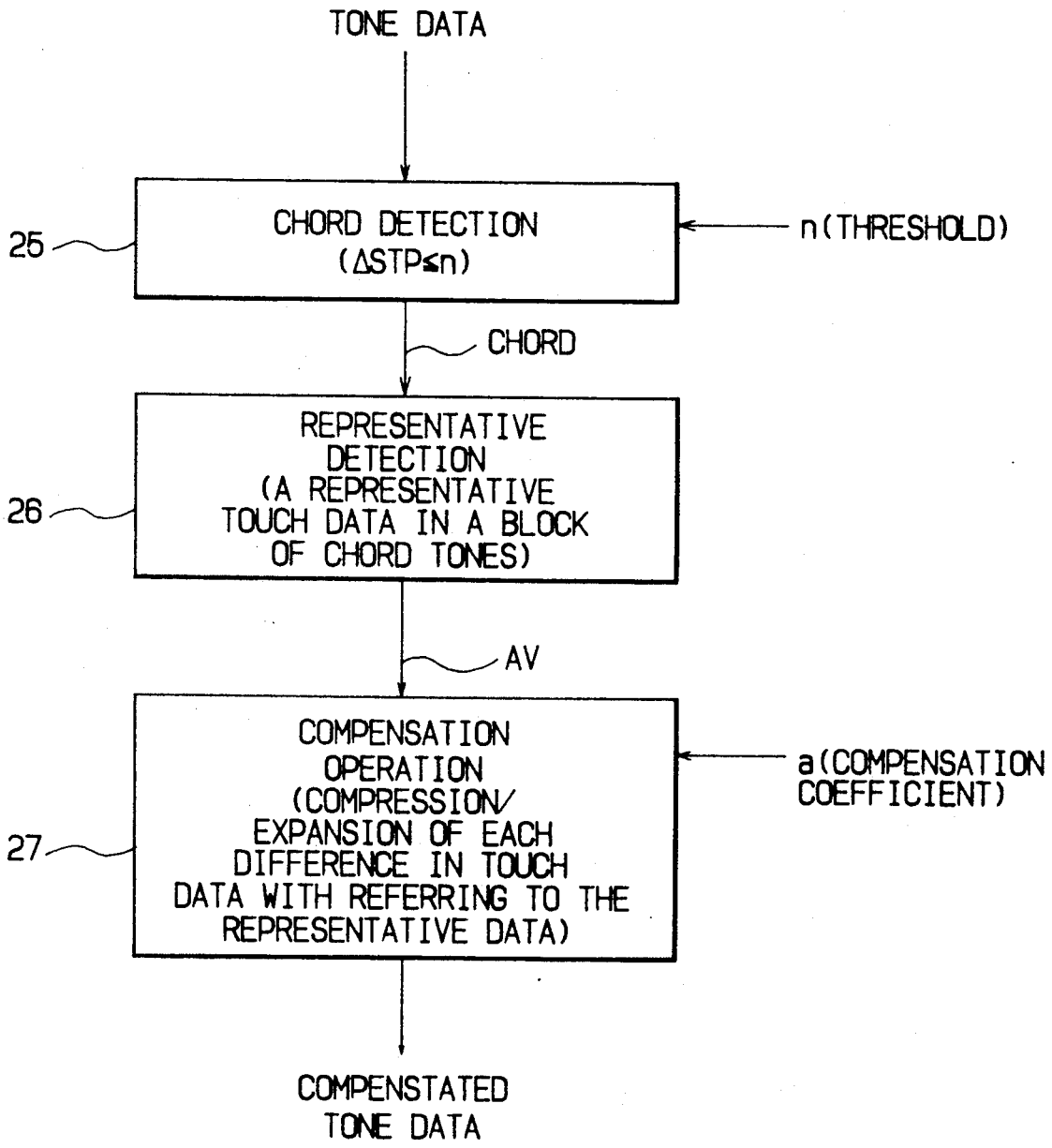
FIG. 4 is a block diagram showing the arrangement of the musical tone data compensation apparatus of the present invention for explaining its operation principle.

FIG. 4 is a functional block diagram showing the arrangement of the present invention for explaining its operation principle. The respective blocks are realized by a CPU, and the programs are stored in a memory in practice.

A chord detection block 25 receives musical tone data, and detects a chord when a time difference (ΔSTP) between adjacent tones is smaller than a predetermined threshold value n. A representative value detection block 26 detects a representative value AV of touch data (key-on strengths, or the like) of a detected one chord block CHORD as, e.g., an average value. A compensation value calculation block 27 calculates a compensation value obtained by compressing (or expanding) the difference between touch data of each tone of one chord block and the representative value based on a predetermined compensation coefficient a (%). a may be set to satisfy $-100 \leqq a \leqq 100$ (%), or may be higher than 100 (%). Compensated touch data are replaced with touch data in original musical tone data, thus obtaining corrected musical tone data.

When reproduced tones are obtained based on compensated musical tone data, a chord sequence which is not monotonous in the overall flow of a music piece, and has a good sound can be obtained. When the compensation coefficient a is set to be a negative value, since key-on strength levels can be reversed with respect to the representative value, performance data input by the right hand can sound as if they were played by the left hand, thus obtaining a special effect.

Touch data compensation processing will be described in detail below with reference to the flow charts shown in FIGS. 5 to 10.

Figure 5:
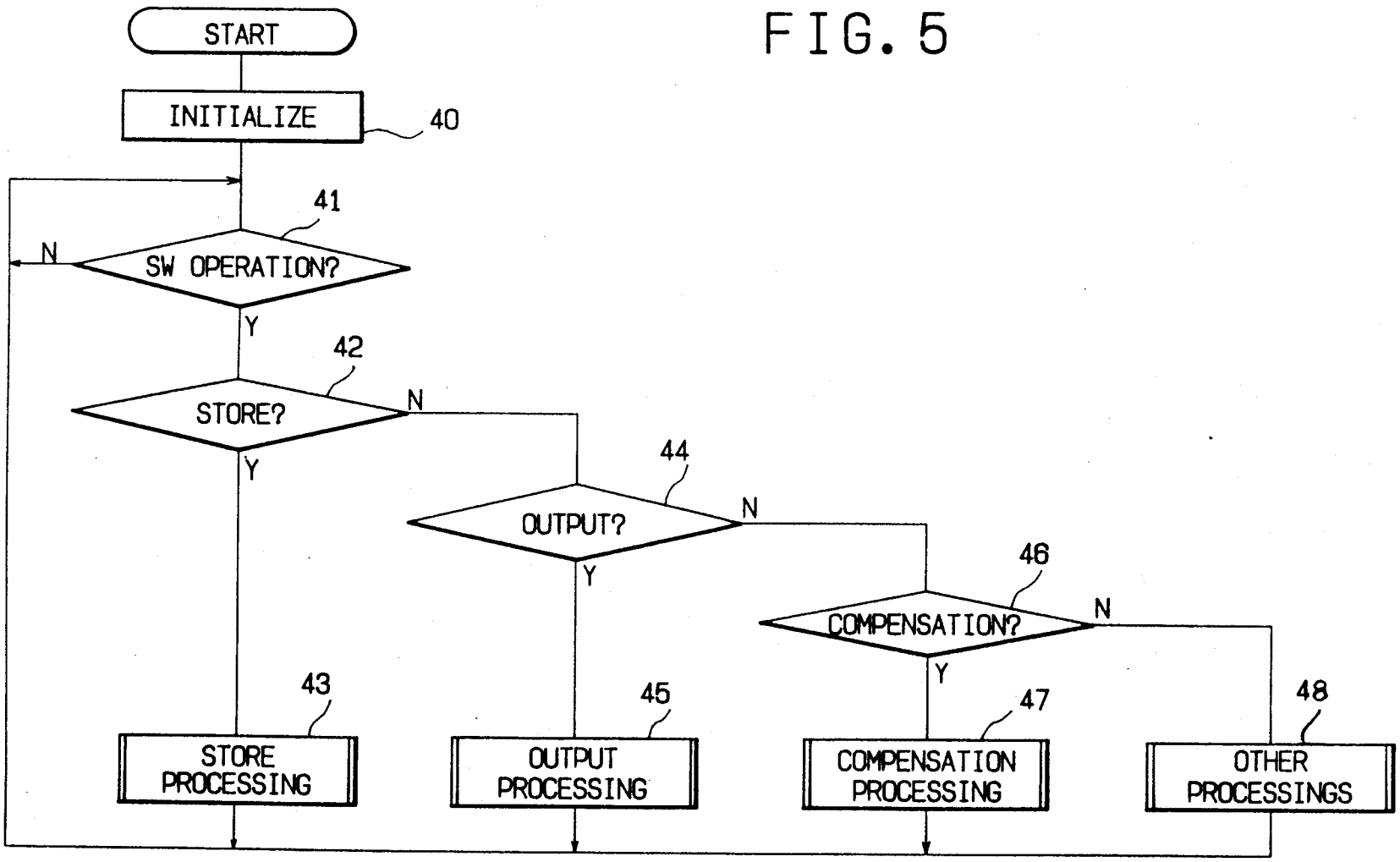
FIGS. 5 to 10 are flow charts showing processing procedures of musical tone data.

FIG. 5 is a main flow chart showing an operation of the system shown in FIG. 1. In step 40, registers for variables, pointers, and the like are initialized. The CPU 10 then performs scanning for detecting an operation of the panel switch (PSW) 15 via the I/O 13 in step 41, and if a store operation (instruction) of performance data is detected, the flow advances from step 42 to a store processing routine 43.

If an output instruction of performance data is detected in operation detection in step 41, the flow advances from step 44 to an output processing routine 45.

If a compensation instruction of performance data is detected upon detection of the operation of the PSW 15, the flow advances from step 46 to a touch data compensation processing routine 47.

If an operation of the PSW 15 instructs a normal performance, the flow advances to step 48 to execute, e.g., known normal performance processing (not described in detail).

Note that the program shown in FIG. 5 is performed continuously. Therefore, when the operation of the PSW 15 cannot be detected in step 41, and when the store, output, compensation, and normal processing routine 43, 45, 47, or 48 is ended, the flow returns to step 41, and the same operation is repeated until the power switch is turned off.

Figure 6:
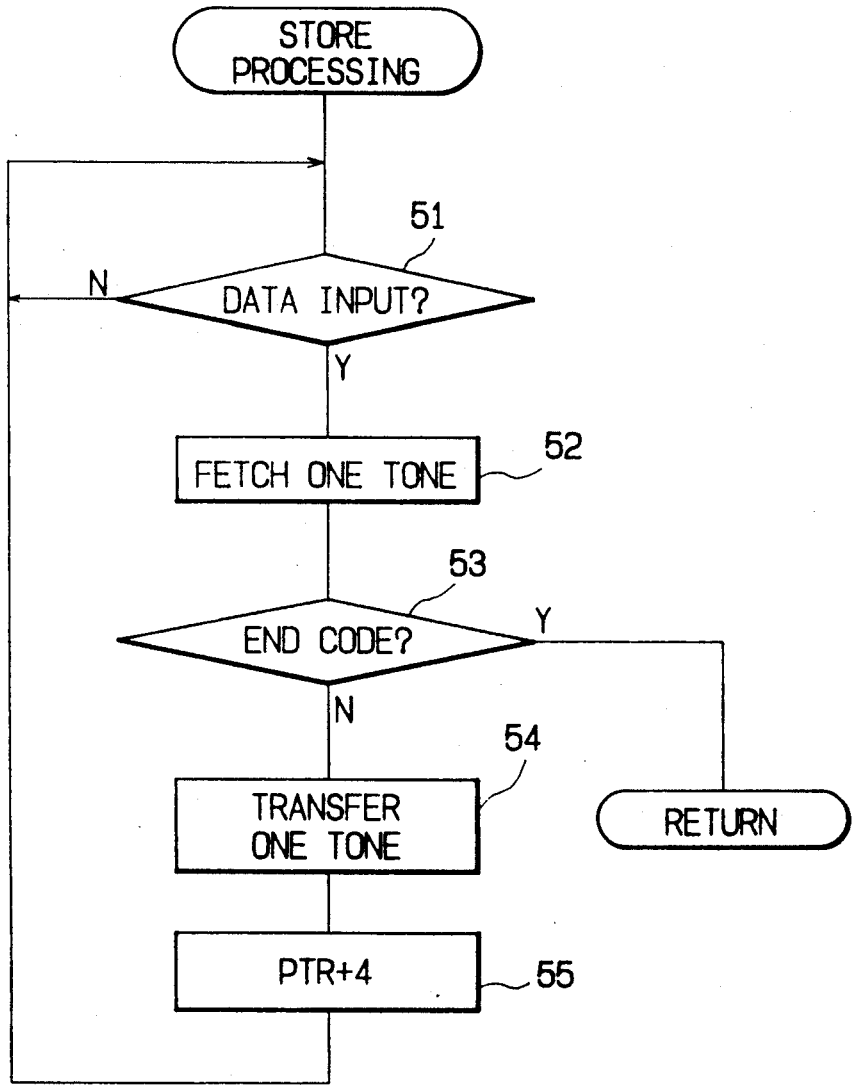

FIG. 6 shows in detail the store routine 43 in FIG. 5. Upon completion of processing of the routine 43, an address pointer PTR indicates the total number of bytes of musical tone data, control data, and bar data currently stored in the RAM 12. In this case, since no performance end data is added, when the store processing routine 43 is successively executed, performance data can be automatically coupled.

In step 51 in FIG. 6, an external input terminal is scanned via the I/O 13, and if input data from, e.g., the key switch 17 is detected, 4-byte musical tone data corresponding to one tone is fetched from the I/O 13 in step 52. It is checked in step 53 if the fetched data is a performance end code. If YES in step 53, the control returns to the main routine. Note that the end code is automatically generated by an interrupt routine (not shown) on the basis of an operation of, e.g., a specific panel switch. This interrupt routine also automatically generates the bar code BAR.

If it is determined in step 53 that the fetched data is not an end code, the fetched 4-byte musical tone data is transferred to the RAM 12 in step 54. Note that a transfer address is generated by adding values of the pointer register PTR and an index register IDX. In this case, the content of the register IDX is 8000H, and an initial value of the register PTR is 0H.

In step 55, the number of bytes of 4 corresponding to one tone is added to the content of the pointer register PTR, and the flow returns to step 51 to repeat the above-mentioned processing.

Figure 7:
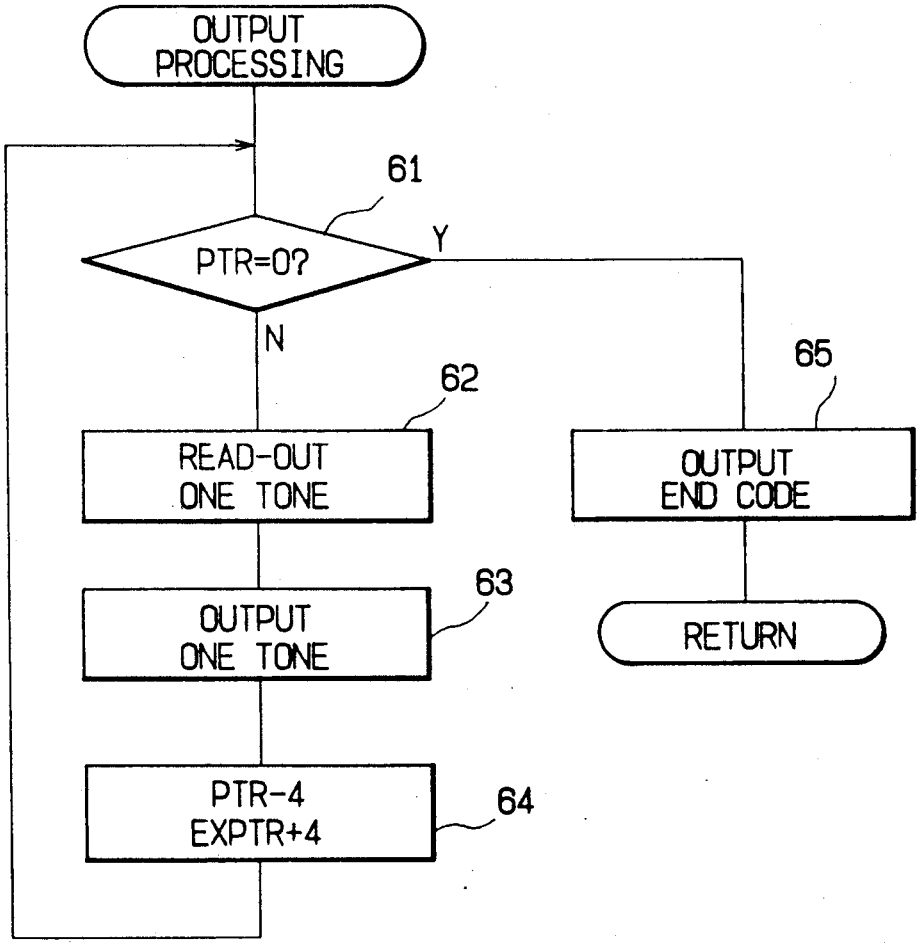

FIG. 7 is a flow chart showing in detail the output processing routine 45 shown in FIG. 5. In this routine, the content of the pointer register PTR is checked in step 61 to see if PTR equals zero. If not, 4-byte musical tone data corresponding to one tone is read out from the RAM 12 in step 62. A read address is generated by adding the content of the index register IDX to the content of a pointer register EXPTR different from the pointer register PTR. The initial value of the register EXPTR is OH.

In step 63, the readout 4-byte data for one tone is output to, e.g., the tone generator 18 via the I/O 13. In step 64, "4" is subtracted from the content of the pointer register PTR, and at the same time, "4" is added to the content of the register EXPTR. Thereafter, the flow returns to step 61.

If it is determined in step 61 that the content of the pointer register PTR is zero, since there is no data to be output, an end code is output via the I/O 13 in step 65, and the control then returns to the main routine.

Figure 8:
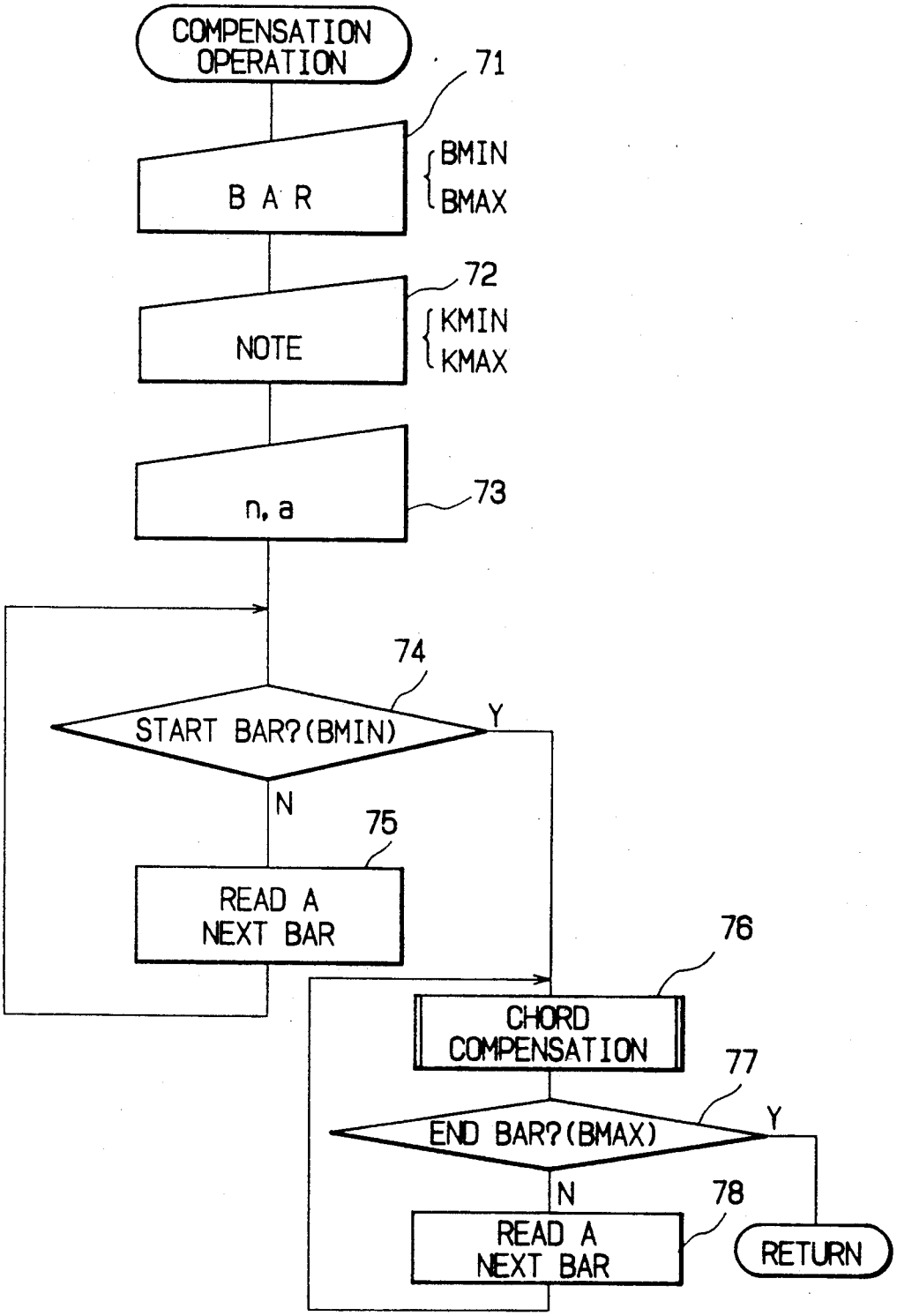

FIG. 8 is a flow chart showing in detail the compensation processing routine shown in FIG. 5. In step 71, a guide message for inputting of start and end numbers of bars BAR to be subjected to data compensation processing is displayed on the LCD 16 via the I/O 13, and a processing start bar number BMIN and a processing end bar number BMAX are received from the PSW 15 via the I/O 13.

In step 72, a guide message for inputting of a processing region is displayed on the LCD 16, and a bass-tone end KMIN and a high-tone end KMAX of the region are received from the PSW 15.

Furthermore, in step 73, a guide message for inputting of the threshold value n and the compensation coefficient a (%) used in chord identification is displayed on the LCD 16, and these data are received from the PSW 15.

In step 74, it is checked if a current bar number indicated by a bar counter BCT (initial value = 1) represents the processing start bar, i.e., if the content of the bar counter BCT is equal to BMIN. If NO in step 74, the next bar data BAR is searched in step 75. If the data BAR is detected, the content of the bar counter BCT is incremented by "1", and the above-mentioned operations are repeated. With this processing, when the content of the bar counter BCT becomes equal to BMIN, the flow advances from step 74 to a chord compensation routine in step 76.

Upon completion of chord compensation processing for one bar, it is checked in step 77 if the content of the bar counter BCT has reached the processing end bar number BMAX. If YES in step 77, the control returns to the main routine; otherwise, the content of the bar counter BCT is incremented by "1", and the chord compensation routine in step 76 is repeated.

Figure 9:
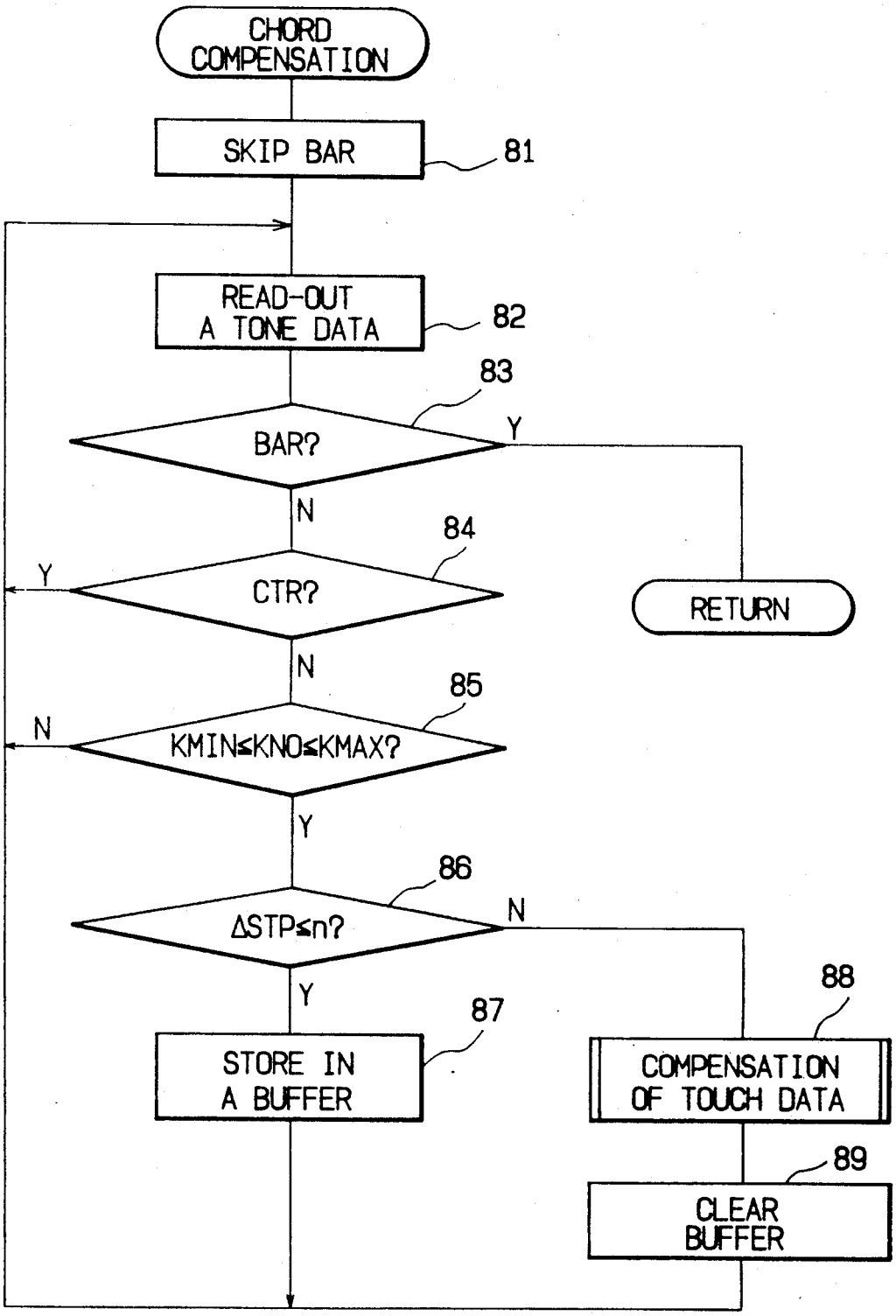

FIG. 9 is a flow chart showing in detail the chord compensation routine in step 76 shown in FIG. 8. In step 81, bar data BAR is skipped (selectively read), and at the same time, a chord detection flag CFG is cleared. In step 82, 4-byte data for one tone is read out from the RAM 12. If it is determined in step 83 that read-out data is bar data BAR, the control returns to the main routine; otherwise, the flow advances to decision step 84. If it is determined in step 84 that the read-out data is control data CTR, the flow returns to step 82 to read out one tone; otherwise, the flow advances to decision step 85. It is checked in step 85 if a key number KNO of the read-out tone data TONE is present between the bass tone end KMIN and the high tone end KMAX of the processing region. If NO in step 85, the flow returns to step 82 to read out one tone; otherwise, the flow advances to step 86 to discriminate a chord.

In step 86, a difference ΔSTP between a step time STP' (the number of clocks from the bar) of the read-out tone data, and a step time STP of tone data read out in the immediately preceding processing is obtained, and it is then checked if the obtained difference is equal to or smaller than the preset chord discrimination threshold value n. That is, when the chord detection flag CFG is cleared, data for the next tone is read out. If it is determined that the read-out data is neither bar data nor control data, but is tone data, and its key number falls within a predetermined tone region, and if it is also determined that a difference from the step time of the immediately preceding tone data is equal to or smaller than the threshold value n, a chord is determined, and the chord detection flag CFG is set. The flow then advances to step 87. In step 87, the previously read tone data is transferred to the buffer area of the RAM 12, and the tone data read later is abandoned. The flow then returns to step 82 to read out one tone, thus repeating the above-mentioned processing. Note that the time STP' is reset to 0H every time the data BAR is detected.

In this manner, a series of chord data are stored in the buffer area. If it is determined in step 86 that the difference ΔSTP between step times of adjacent tones is larger than the threshold value n, since a division of a chord is detected, touch data compensation processing is executed in step 88. In step 89, the compensated touch data is rewritten (recalled) in the performance data area of the RAM 12, and the buffer area is cleared. The flow then returns to step 82 to process the next chord.

When the flow advances from step 86 to step 88, if it is previously determined in step 86 that $\Delta STP \leqq n$, the previously read tone data is transferred to the buffer area of the RAM 12, and the tone data read later is abandoned.

Figure 10:
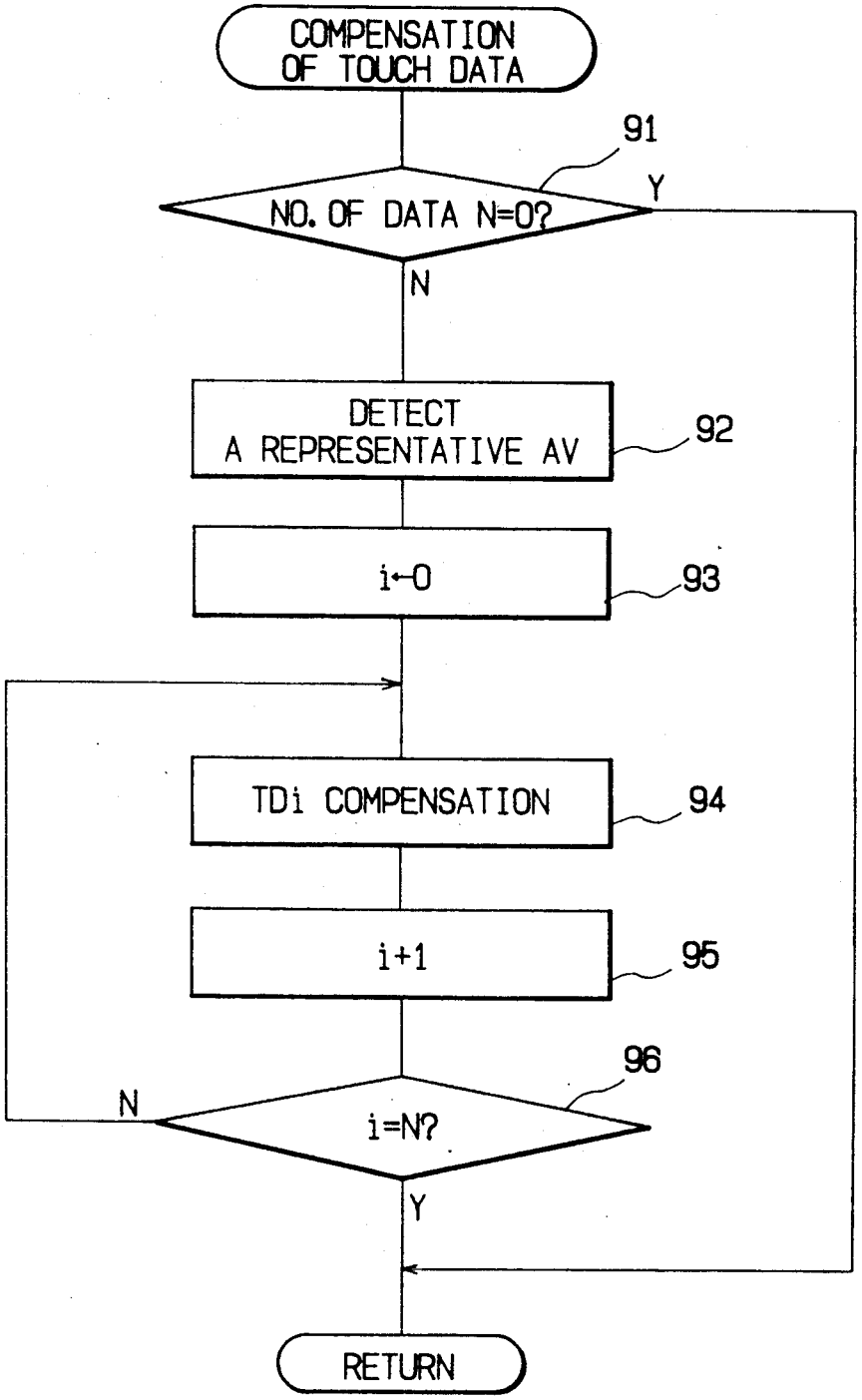

FIG. 10 is a flow chart showing in detail the touch data compensation routine in step 88 in FIG. 9. In step 91, it is checked if the number N of tone data transferred to the buffer area is zero. If YES in step 91, the flow returns to the main routine; otherwise, touch data TD of tone data stored in the buffer area are totaled to obtain a representative value AV in step 92. A formula for calculating the AV may be one for obtaining an average of all the touch data as follows:

$$AV = \Sigma TD_i N \quad (1)$$

Alternatively, the formula for calculating the AV may be one for obtaining a middle value between a maximum value $AV_{max}$ and a minimum value $AV_{min}$ of touch data as follows:

$$AV=(AV_{max}+AV_{min})/2 \quad (2)$$

In addition, a mode, a central value, a mean value, or the like may be used.

In step 93, a loop counter is set to be 0, and a compensation calculation of touch data $TD_i$ of ith tone data in the buffer area on the basis of the predetermined compensation coefficient a is performed. The compensation formula can be given by:

$$TD_i'=AV+(TD_i-AV)\times a/100 \quad (3)$$

More specifically, the difference (deviation) between touch data $TD_1$ to be compensated and the representative value of touch data in the chord is multiplied with the compensation coefficient a (%), and the product is added to the representative value AV. When the compensation coefficient a is positive, the compensated touch data TD' is compressed in a direction to decrease a difference from the representative value AV. If the coefficient a is negative, the relationship of the strength level of the compensated touch data TD' is reversed. If the coefficient a is positive or negative, and is larger than 100%, the touch data TD' is compensated to increase a difference from the representative value. Note that if the coefficient a is 100%, compensation is zero. If the coefficient a is 0%, touch data of all the chord tones are uniformly set to be the representative value AV.

Upon completion of compensation step 94, the content of the loop counter i is incremented by 1 in step 95. It is then checked in step 96 if i is equal to the number N of tone data in the buffer. If YES in step 96, the flow returns to the main routine; otherwise, the flow returns to compensation step 94 to repeat the above-mentioned processing.

FIG. 11 shows an example wherein touch data are compensated over the entire tone region to have the threshold value n=2 (clocks), and the compensation coefficient a=50 (%). In this example, key-on velocity data (velocity: Vel) was used as touch data TD, and an average value was employed as the representative value of touch data.

As can be understood from FIG. 11, tone data whose key-on timings have a difference of 2 clocks or less are determined as one chord. In the first chord block in FIG. 11, an average AV of original touch data Vel-org is 92, and touch data Vel-new compensated based on equation (3) is compressed to approach the average=92. More specifically, variations of touch data of the respective tones in the chord are compressed to be decreased by about 50% with respect to the average value.

The embodiment of the present invention has been described. However, the present invention is not limited to the above embodiment, and various effective modifications may be made based on the technical concept of the present invention.

For example, in the above embodiment, performance data is supplied from the key switch 17. However, the performance data may be supplied from an external storage device or another electronic musical instrument connected to the I/O 13.

Touch data associated with a key-on operation is not limited to the above-mentioned key-on strength value (velocity), but may be various other data associated with a touch of a key such as after touch data representing a key-on force.

According to the musical tone data compensation apparatus of the present invention, even when key-on timings are shifted from each other, a chord can be reliably detected from musical tone data, and touch data values of the extracted chord can be compensated in units of chords. Therefore, even a beginner can easily edit touch data of a chord by using this apparatus. A chord sequence intended by a user, which is not monotonous in the overall flow of a music piece, and has a good sound can be easily and reliably obtained.

What is claimed is:

1. A musical tone data compensation apparatus comprises:

chord detection means for extracting, as a chord, a group of musical tone data, which have a difference in tone generation timings of individual musical tones smaller than a predetermined duration value, from performance data including a sequence of musical tone data including touch data associated with a key-on operation;

representative value detection means for detecting a representative value of original values of touch data of the detected chord; and compensation calculation means for calculating new values of individual touch data obtained by compressing or expanding differences between the original values of touch data of the detected chord and the representative value at a predetermined ratio, wherein musical tone data including the compensated new values of the touch data of the chord are obtained;

said component calculation means calculating the new values of individual touch data according to:

$$TD'=AV+(TD-AV)\times a/100$$

wherein

TD'=the new values of individual touch data

TD=the original values of individual touch data

AV=the representative value of the original values of individual touch data a=a compensation coefficient.

2. The apparatus of claim 1, wherein said chord detection means includes means for inputting the predetermined duration value.

3. The apparatus of claim 1, wherein said compensation calculation means includes means for detecting whether note data in the musical tone data falls within a predetermined tone region having a predetermined width, and said compensation calculation means performs a compensation calculation by excluding data falling outside the predetermined tone region having the predetermined width.

4. The apparatus of claim 1, wherein said compensation calculation means includes means for inputting a compensation coefficient for determining the compression or expansion ratio.

5. A musical tone data compensation apparatus comprising:

chord detection means for detecting a chord from a plurality of musical tone data generated by a key-on operation, each of the plurality of musical tone data having different tone generation timing and different original touch data, if a difference in the tone generation timing is less than a predetermined duration value;

representative touch data value calculating means for calculating a representative touch data value from the different original touch data for each of the plurality of musical tone data which make up the detected chord; and compensation calculation means for calculating new touch data for each of the plurality of musical tone data by compressing or expanding differences between the original touch data and the representative touch data value data predetermined ratio;

wherein said compensation calculation means calculates the new touch data for each of the plurality of musical tone data according to:

$$TD' = AV + (TD - AV) \times a/100$$

wherein

TD' = the new values of individual touch data

TD = the original values of individual touch data

AV = the representation value of the original values of individual touch data a = a compensation coefficient.

6. The apparatus of claim 5, wherein said chord detection means includes means for inputting the predetermined duration value.

7. The apparatus of claim 5, wherein said compensation calculation means includes means for detecting whether note data in the plurality of musical tone data falls within a predetermined tone region having a predetermined width, and wherein said compensation calculation means calculates the new touch data from each of the plurality of musical tone data by excluding data falling outside the predetermined tone region having the predetermined with.

8. The apparatus of claim 5, wherein the representative touch data value is the mean of the different original touch data for each of the plurality of musical tone data.

9. The apparatus of claim 5, wherein the representative touch data value is the median of the different original touch data for each of the plurality of musical tone data.

10. The apparatus of claim 5, wherein the representative touch data value is the mode of the different original touch data for each of the plurality of musical tone data.

11. The apparatus of claim 5, wherein the plurality of musical tone data is supplied by an external storage device.

12. The apparatus of claim 5, wherein the different original touch data for the plurality of musical tones is key-on strength data.

13. The apparatus of claim 5, wherein the different original touch data for the plurality of musical tones is key-on force data.

* * * * *